United States Patent [19]

Roth

[11] 3,942,686

[45] Mar. 9, 1976

[54] GLUEING DEVICE

[75] Inventor: Oscar Roth, Zurich, Switzerland

[73] Assignee: Involvo AG, Bunzen, Switzerland

[22] Filed: May 1, 1974

[21] Appl. No.: 466,031

[30] Foreign Application Priority Data

May 2, 1973 Switzerland ..... 6199/73

[52] U.S. Cl. ..... 222/146 HE; 91/275

[51] Int. Cl.[2] ..... B67D 5/62

[58] Field of Search ..... 222/146 HE, 334; 417/404; 91/275, 337

[56] References Cited

UNITED STATES PATENTS

| | | | |
|---|---|---|---|
| 3,827,603 | 8/1974 | Reighard et al. | 222/146 HE |
| 3,851,801 | 12/1974 | Roth | 222/383 X |

*Primary Examiner*—Robert B. Reeves
*Assistant Examiner*—John P. Shannon
*Attorney, Agent, or Firm*—Michael J. Striker

[57] ABSTRACT

The gluing device includes a glue storage and heating unit, a valve unit, a pump unit, a pressure-equalizing unit and a nozzle head. A support is provided which has two parts which are thermally insulated from one another, one of the parts supporting the glue storage and heating unit, and the other part supporting and including the other units and the nozzle head. Two separately energized heating rods are provided, each of which heats one of the parts of the support. An actuating arrangement is provided for the pump unit and includes an actuating piston reciprocating in a cylinder bore and actuated by a pressurized medium introduced into the cylinder bore and connected to the pump unit. A control arrangement controls the supply of the pressurized medium into the cylinder bore of the actuating arrangement and includes a switch, a rod mounted for retarded movement in the actuating arrangement in axial parallelism with the cylinder bore and acting on the switch, and a pair of abutment pins connected to the rod and extending into the path of reciprocation of the actuating piston so that said pins and said rod share the movement of the actuating piston when the latter approaches any one of the end positions thereof with the attendant actuation of the switch in a sense reversing the mode of operation on the actuating arrangement.

6 Claims, 5 Drawing Figures

II
1
2
3
4
5
6
7
8
9
10

GLUEING DEVICE

The invention relates to a gluing device for packing machines, the device comprising a glue-melting pot, a nozzle head and, disposed therebetween, a glue pump, the nozzle of the nozzle head being adapted to be opened or closed at choice.

Gluing devices of this kind are known; they comprise a central glue-melting facility and a central glue pump to which one or more nozzle heads are connected by way of flexible pressure lines. The known devices have three considerable disadvantages. In the first place, the central gluing device is always the same size, and the glue pump is always the same size, irrespective of the number of nozzle heads. If only one or two nozzle heads are required for a packing machine, the costs for the glue-melting facility and the glue pump are excessive. In the second place, the glue pump and the nozzle heads have to be interconnected by heatable pressure lines or hoses. Hoses of this kind must be produced in various standard lengths, since the distance between a nozzle head and the glue pump varies in different kinds of packing machines.

In the third place, the hoses must be heatable and are relatively difficult to clean.

According to the invention, to obviate these disadvantages, the glue-melting pot, nozzle head and glue pump are mounted on a carrier block having heating elements.

The invention renders possible the provision of a relatively inexpensive small gluing device for each gluing station.

The invention will be described by way of example with reference to the accompanying diagrammatic drawings wherein.

Figures 1, 5:
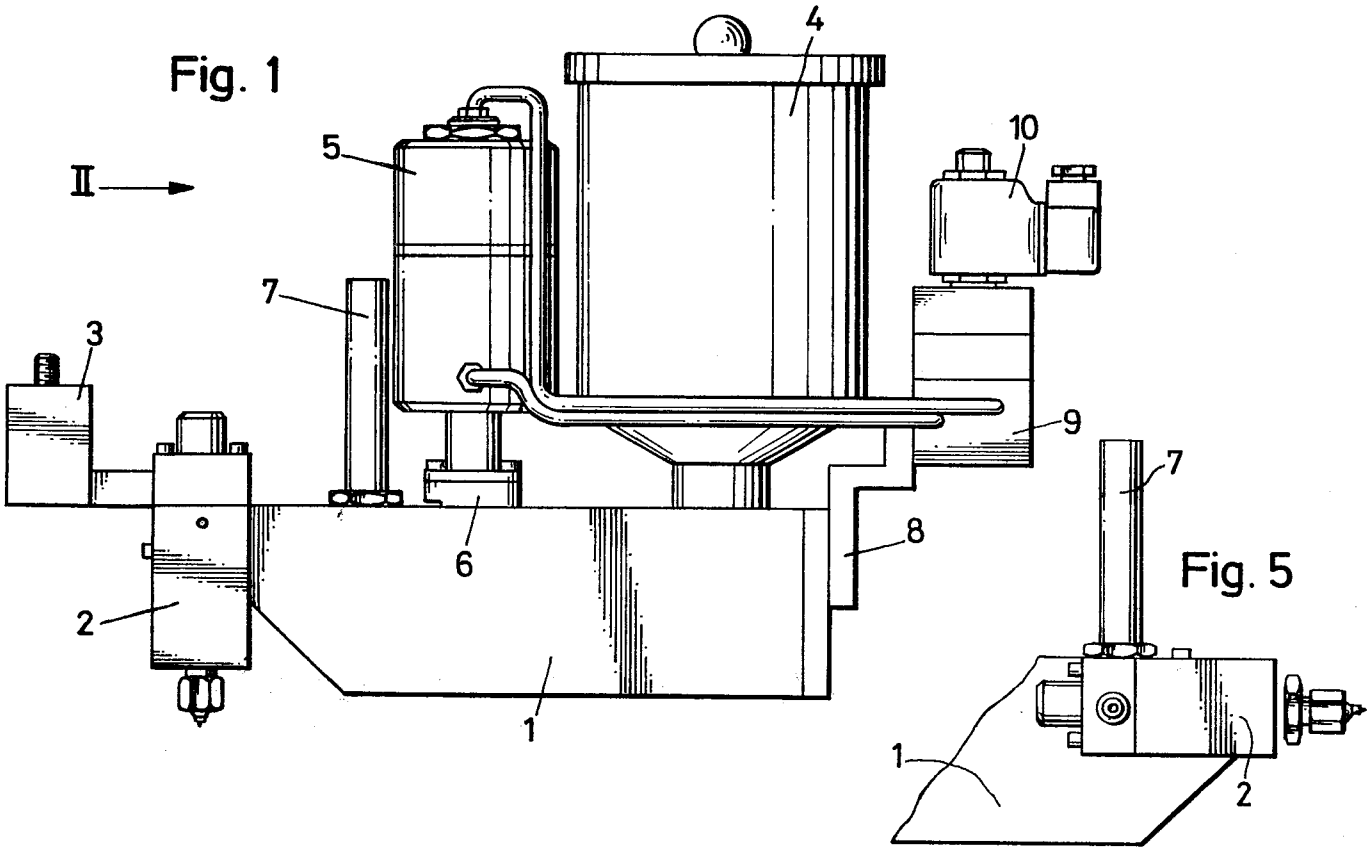
FIG. 1 is a side elevational view of a gluing device.
FIG. 5 is a partial side elevational view of the gluing device with a horizontal nozzle head.
Figure 2:
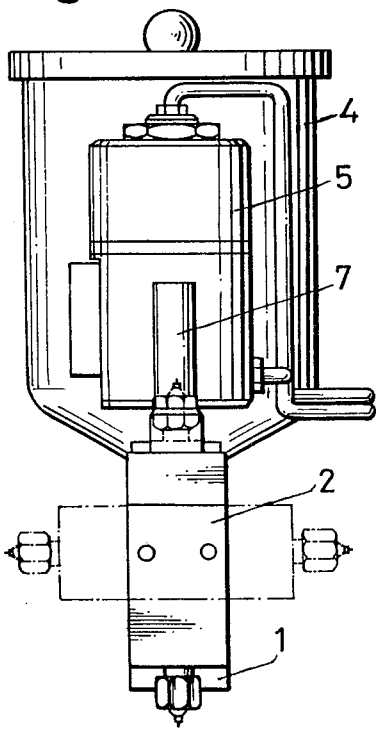
FIG. 2 is a front elevational view of the gluing device in the direction of the arrow II of FIG. 1.
Figure 3:
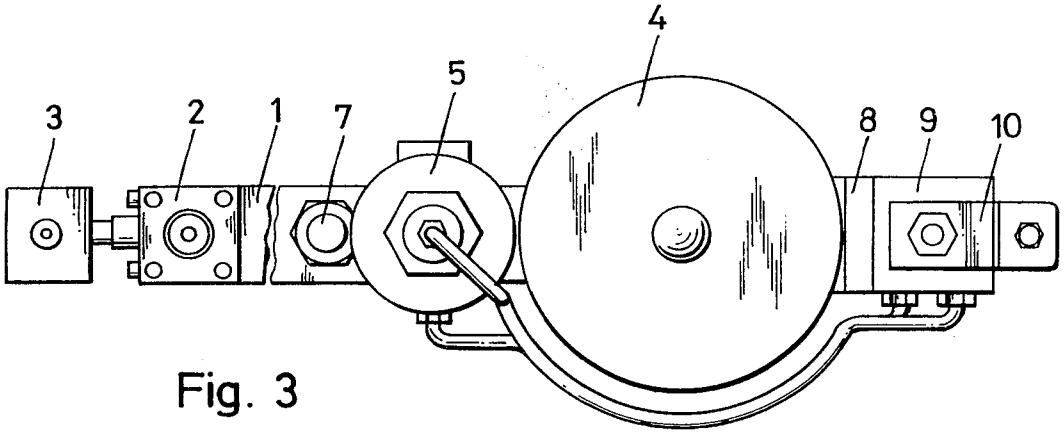
FIG. 3 is a top plan view of the gluing device of FIG. 1.

As FIGS. 1 to 3 show, the gluing device comprises a carrier block or unit 1 to which a nozzle unit 2 is secured. The nozzle unit 2 carries a multiway valve 3 controlling the opening and closure of a nozzle 50. A glue storing and heating unit 4, a pump drive casing 5 for a glue pump 6 and a pressure-equalizing vessel 7 are supported on the carrier unit 1. Also mounted on the carrier unit 1 is a bracket 8 which carries a multiway valve 9 having a magnetic winding 10.

Figure 4:
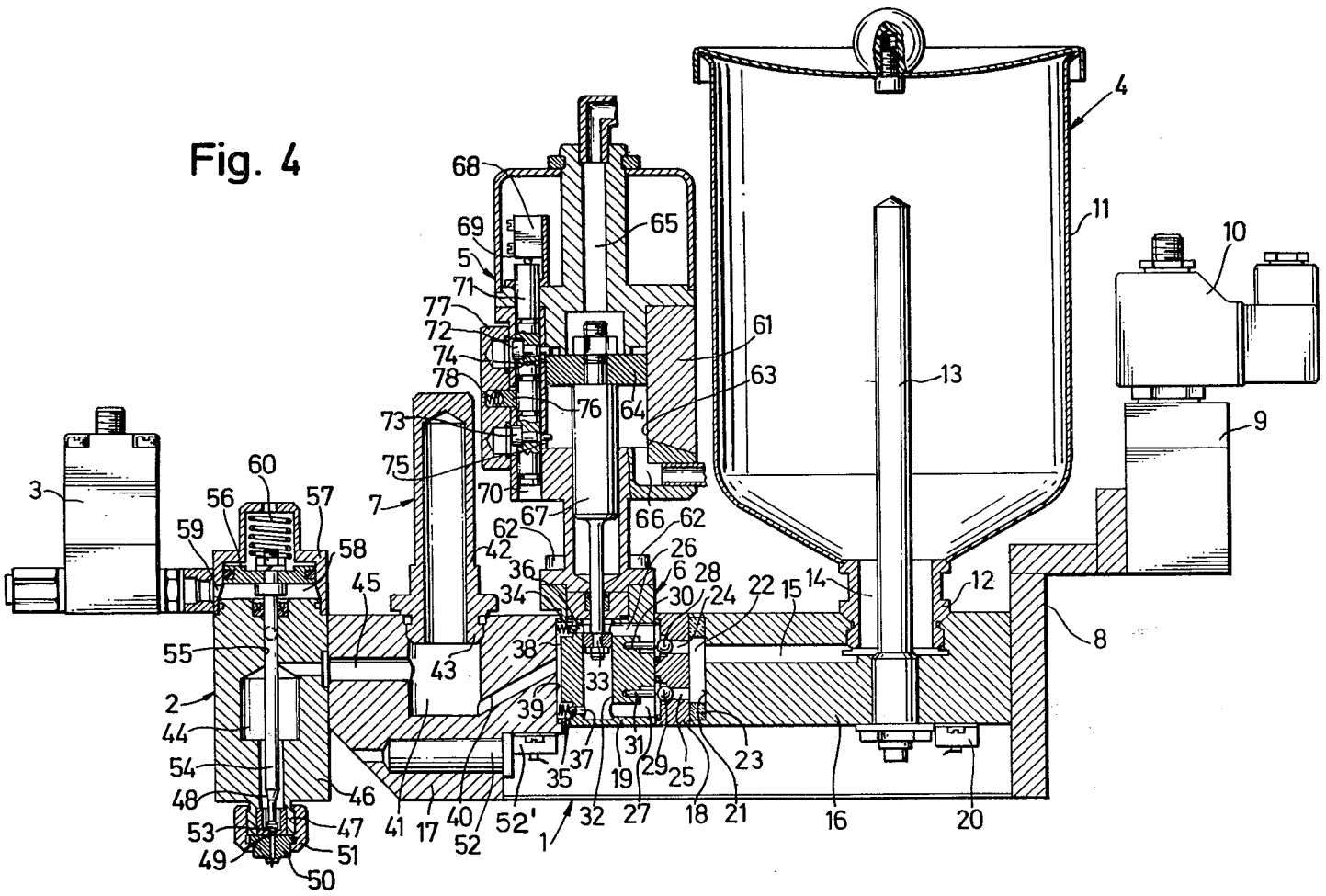
FIG. 4 is a sectional view similar to FIG. 1.

The glue storing and heating unit 4 comprises a glue container 11 having a screwthreaded extension 12. Disposed in container 11 axially thereof is a heating bar or rod 13 which, together with the screwthreaded extension 12, forms a flow channel 14 connected to a horizontal passage 15. The carrier unit 1 is combined from four rigidly interconnected parts, namely a first end unit 16 which supports the glue storing and heating unit 4, a second end unit 17 carrying the pressure-equalizing vessel 7 and the nozzle head 2 and, intermediate the two end units 16 and 17, a valve unit 18 and a pump unit 19. The four units 16 – 19 are made of a material which is a good heat conductor. Disposed in the first end unit 16 is a thermostat 20 which controls the heating element 13 so that the glue in the glue storing and heating unit 4, and the end unit 16, can be maintained at predetermined temperatures. The end unit 16 is formed with a cylindrical recess 21 which cooperates with the valve unit 18 to bound a distribution chamber 22. A heat insulation ring 23 is provided in the distribution chamber 22 and inhibits the flow of heat from the first end unit 16 to the valve unit 18. Passages 24, 25 are provided in the valve unit 18 and connect the distribution chamber 22 to passages 26 and 27 provided in the pump unit 19. The passages 24, 25 can be closed by spherical elements 28, 29, respectively, each of which operates as a one-way valve. The displacement of the spherical elements 28, 29 is limited by pins 30, 31, respectively, which are affixed to the in pump unit 19. The passages 26, 27 communicate with a cylinder bore 32 which is provided in the pump unit 19 and in which a pump piston 33 is mounted for vertical reciprocation. Two passages 36, 37 closable by one-way valves 34, 35 respectively extend from the cylinders bore 32 to a collecting chamber 38. The collecting chamber 38 is bounded by a recess 39 in the second end unit 17 and by the pump unit 19. The collecting chamber 38 communicates via a passage 40 with an equalizing chamber 41 provided in the second end unit 17; the chamber 41 is extended upwardly by a cylindrical member 42 which together with the chamber 41 forms the pressure-equalizing vessel 7. Accordingly, the cylindrical member 42 has at its base a screwthread 43 and is screwed into a corresponding internal screwthread in the wall defining the equalizing chamber 41. A second equalizing chamber 44 in the nozzle head 2 communicates with the above-mentioned equalizing chamber 41 by way of a passage 45. The nozzle head 2 has a housing member 46 which has a screwthreaded axial extension 47. A bore 48 extends from the second equalizing chamber 44 into the screwthreaded extension 47, and a passage 49 of much smaller cross-section than that of the bore 48 communicates with the latter and extends into the end face of the screwthreaded extension 47. The nozzle 50 is mounted coaxially of the passage 49 and is tightly connected to the screwthreaded extension 47 by means of a nut 51. The glue which has been melted in the glue storing and heating unit 4 is drawn by the vertically reciprocating pump piston 33 and leaves the glue storing and heating unit 4 through the passages 14, 15, chamber 22 and passages 24 – 27 to enter the cylinder bore 32. When the pump piston 33 descends from its top end position illustrated in FIG. 4, the glue present in the cylinder bore 32 is compressed and therefore flows through the passage 37 into the chamber 38. The spherical element 29 prevents any flowback through the passage 27, the spherical element 29 closing the passage 25 in response to the pressure produced by the pump piston 33. While the pump piston 33 is descending from its top end position to its bottom end position, it generates a negative pressure in the passage 26, so that the spherical element 28 opens the passage 24 and glue can be drawn from the chamber 22 into the passage 26. The negative pressure produced by the descending pump piston 33 causes the one-way valve 34 to close, thus preventing the possibility that of the glue which is present in the chamber 38 may be drawn back. When the piston 33 rises from its bottom end position, the glue present in the cylinder bore 32 is delivered through the passage 36 into the chamber 38, the one-way valves 28, 35 closing and the one-way valve 29 opening so that more glue can enter the cylinder bore 32. The liquid glue is forced from the chamber 38 through the passage 40 into the pressure-equalizing vessel 7 which equalizes out any pressure variations resulting from the reciprocation of the pump piston 33. The liquid glue flows at a substantially constant pressure through the passage 45 into the second equalizing chamber 44 in the nozzle head 2 and thence flows through the passages 48, 49 to the nozzle 50. A heating rod 52 heats the second end unit 17, pump unit 19 and valve unit 18. The heating rod 52 is controlled by a thermostat 52'. For metering the glue leaving the nozzle 50, the passage 49 can be closed by a ball 53 disposed at the end of a piston rod 54 which can move axially in the passage 48. The piston rod 54 is mounted for axial movement in a passage 55 which is coaxial of the second equalizing chamber 44 and which is provided in the housing member 46; the piston rod 54 has a piston 56 at its other end. A casing 57 is rigidly secured to the housing member 46. The housing member 46, the casing 57 and the piston 56 define a pressure chamber 58 which is connected to the multiway valve 3 by way of a venting orifice 59. A helical compression spring 60 which is disposed between the piston 56 and the casing 57 presses the piston 56 and therefore the ball 53 downwards so that the ball 53 closes the passage 49. The valve 3 is connected to a non-illustrated source of compressed air. When compressed air enters the chamber 58, the piston 56 rises and the ball 53 at the end of the rod 54 opens the passage 49 so that glue can issue from the nozzle 50. When the valve 3 is operated to relieve the pressure in the chamber 58, the spring 60 forces the piston 56 downwards, so that the passages 49 is closed and glue ceases to issue from the nozzle 50.

The heating element 52 heats the liquid glue in the regions of the valve unit 18, the pump unit 19, the second end unit 17 and the nozzle head 2 to a higher temperature than in the region of the first end unit 16, since the glue spends less time near the units 17 to 19 than near the unit 16 and is therefore not damaged by heating despite the high temperature.

A description will now be given of the drive and control of the pump piston 33. The pump drive casing 5 has a cylinder 61 which is rigidly connected by screws 62 to the pump unit 19. A piston 64 is mounted for movement in a bore 63 provided in the cylinder 61. To move the piston 64, two air passages 65, 66 extend into the bore 63 and are supplied alternately with compressed air by way of lines (not shown) and of the multiway valve 9. The driving piston 64 is rigidly connected by a piston rod 67 to the pump piston 33 so that the two reciprocate vertically with the same stroke in their respective bores 63, 32. The magnetic winding 10 which operates the multiway valve 9 is energized or de-energized by means of a switch 68 adapted to be operated by a cam 69. To operate the same, a passage 70 is provided in the cylinder 61 parallel to the axis of the bore 63 and a rod 71 is mounted for movement axially of the passage 70. Screwed into the rod 71 are two screws 72, 73 whose respective projecting ends extend through respective apertures 74, 75 into the bore 63 to cooperate as abutments with the piston 64. A resilient brake pin 76 contacts, and retards the movement of the rod 71 in the passage 70. The brake pin 76 is mounted for axial displacement in a cover 77 secured to the cylinder 61 and is pressed against the rod 71 by a helical spring 78. When the piston 64 descends from its top end position illustrated in FIG. 4, shortly before reaching its bottom end position it strikes the abutment screw 73 which then shares the downward movement of the piston 64 toward its bottom end position, the rod 71 also descending and releasing the cam 69. An electric circuit (not shown) is interrupted by the switch 68 and the winding 10 operates the valve 9, whereafter the piston 64 rises. Shortly before reaching its top end position, the piston 64 strikes the abutment screw 72 and causes the rod 71 to move upwards until the piston 64 it has reached its top end position, whereby the rod 71 abuts against the cam 69 and closes the circuit previously referred to. The winding 10 then operates the valve 9 again, whereafter the movements of the piston 64 which have been just described are repeated. The advantage of the control system described is that the winding 10 can be operated by means of a simple contact switch, there being virtually no wear of the mechanical actuating elements 71 - 73.

As can be gathered from FIG. 2, the nozzle unit 2 can be secured to the second end unit 17 at angular offsets of 90 or 180° or 270°. Also, and as FIG. 5 shows, the nozzle head 2 can be secured to the carrier unit 1 as an extension thereof, so that the nozzle axis is oriented in the direction of the carrier unit 1.

In an embodiment which is not shown, intermediate units can be arranged between the end unit 17 and the nozzle head 2 to increase the distance between the nozzle head 2 and the pressure-equalizing vessel 7, to suit special packing machine requirements.

I claim:

1. A gluing device for packing machines comprising, in combination, glue storing means; nozzle means; control means for said nozzle means; pump means intermediate and in communication with said glue storing means and said nozzle means and including a double-acting reciprocating pump having a pump casing and a piston mounted in said casing for reciprocation with respect thereto; support means for said glue storing, pump and nozzle means; heating means connected to said support means; and actuating means for said pump means comprising a cylinder housing connected to said casing and defining a cylinder bore, an actuating piston mounted in said bore for reciprocation therein between two end positions, means for supplying an actuating medium into said cylinder bore so as to reciprocate said actuating piston therein, a piston rod connecting said piston to said actuating piston so that the former shares the reciprocating movement of the latter, and means for controlling said supplying means and including a control rod mounted for movement in a bore provided in said cylinder housing in axial parallelism with said cylinder bore, a pair of abutment screws connected to said control rod and projecting into said cylinder bore and into the path of reciprocation of said actuating piston, a spring-biased braking pin acting on said control rod so as to prevent the latter from conducting movement axially of said bore when said abutment screws are out of contact with said actuating piston and to permit such movement when one of said abutment screws is contacted by and entrained by said actuating piston as the latter approaches one of said end positions thereof, and a switch operative for controlling the flow of the actuating medium into said cylinder bore and having a cam cooperating with said control rod.

2. A gluing device as defined in claim 1, wherein said pump means includes a pump casing; and wherein said pump casing is incorporated into said support means.

3. A gluing device as defined in claim 1, and further comprising pressure-equalizing means intermediate and in communication with said pump means and said nozzle means.

4. A gluing device as defined in claim 1, wherein said support means includes a first end unit supporting said glue storing means, a second end unit supporting said nozzle means, a valve unit, and a pump unit intermediate said first and second end units and connected thereto and to one another; wherein said heating means includes a first heating rod connected to and heating said first end unit and said glue storing means, and second heating unit connected to and heating at least one of said second end unit, valve unit and pump unit, said first and second heating rods being energized independently of one another; and further including heat-insulating means interposed between said first end unit and said valve unit so as to thermally insulate the former from the latter.

5. A gluing device for packing machines comprising, in combination, glue storing means; nozzle means; pump means; pressure-equalizing means; support means including a support plate composed of at least three discrete connectable sections, respective ones of said sections supporting said glue storing means, said pump means, and said pressure-equalizing means, said sections each being provided with passage portions which, when said sections are connected, form a passage extending from said glue storing means through said pump means to said nozzle means, said pressure-equalizing means communicating with said pressure intermediate said pump means and said nozzle means; and heating means accommodated in the respective sections of said support plate and operative for heating the same.

6. A gluing device as defined in claim 5, wherein said pump means includes a pump casing; and wherein said pump casing constitutes one of said sections.

* * * * *